US008628187B2

(12) United States Patent
Roof et al.

(10) Patent No.: US 8,628,187 B2
(45) Date of Patent: Jan. 14, 2014

(54) METHODS OF FORMING IMAGES ON SUBSTRATES WITH INK PARTIAL-CURING AND CONTACT LEVELING AND APPARATUSES USEFUL IN FORMING IMAGES ON SUBSTRATES

(75) Inventors: Bryan J. Roof, Newark, NY (US); Jacques K. Webster-Curley, Perry, NY (US); Michelle N. Chrétien, Mississauga (CA); David M. Thompson, Webster, NY (US); Peter G. Odell, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 238 days.

(21) Appl. No.: 12/881,715

(22) Filed: Sep. 14, 2010

(65) Prior Publication Data

US 2012/0062666 A1 Mar. 15, 2012

(51) Int. Cl.

| | |
|---|---|
| ***B41J 2/01*** | (2006.01) |
| ***B41J 29/38*** | (2006.01) |
| ***B41J 29/377*** | (2006.01) |
| ***B41J 2/16*** | (2006.01) |

(52) U.S. Cl.

USPC ..... 347/102; 347/16; 347/18; 347/51

(58) Field of Classification Search

None

See application file for complete search history.

(56) References Cited

U.S. PATENT DOCUMENTS

| | | | | |
|---|---|---|---|---|
| 4,130,056 | A * | 12/1978 | Mabrouk et al. | 101/141 |
| 7,510,277 | B2 * | 3/2009 | Konno et al. | 347/102 |
| 7,531,582 | B2 | 5/2009 | Toma et al. | |
| 7,559,639 | B2 | 7/2009 | Belelie et al. | |
| 7,665,835 | B2 | 2/2010 | Goredema et al. | |
| 7,714,040 | B2 | 5/2010 | Toma et al. | |
| 7,789,503 | B2 * | 9/2010 | Kusunoki | 347/102 |
| 2005/0041053 | A1 * | 2/2005 | Hasebe et al. | 347/18 |
| 2006/0066704 | A1 * | 3/2006 | Nishida | 347/103 |
| 2007/0120930 | A1 | 5/2007 | Domoto et al. | |
| 2007/0123606 | A1 | 5/2007 | Toma et al. | |
| 2008/0218574 | A1 * | 9/2008 | Furuno et al. | 347/100 |
| 2009/0135239 | A1 * | 5/2009 | Chretien et al. | 347/102 |
| 2010/0101716 | A1 | 4/2010 | Roof et al. | |
| 2010/0101717 | A1 | 4/2010 | Roof | |
| 2010/0103235 | A1 | 4/2010 | Roof et al. | |
| 2010/0182378 | A1 * | 7/2010 | Mitsuzawa | 347/51 |

* cited by examiner

*Primary Examiner* — Stephen Meier
*Assistant Examiner* — Alexander C Witkowski
(74) *Attorney, Agent, or Firm* — Ronald E. Prass, Jr.; Prass LLP

(57) ABSTRACT

Methods of forming images on substrates in printing and apparatuses for forming images on substrates in printing are provided. An exemplary embodiment of the methods of forming images on substrates in printing includes applying ink onto a surface of a substrate; irradiating the ink on the surface of the substrate with first radiation to partially-cure the ink; applying pressure to the substrate and partially-cured ink at a nip with a first surface of a first member and a second surface of a second member to level the ink on the surface of the substrate; and irradiating the as-leveled ink on the surface of the substrate with second radiation to substantially fully cure the ink.

16 Claims, 2 Drawing Sheets

METHODS OF FORMING IMAGES ON SUBSTRATES WITH INK PARTIAL-CURING AND CONTACT LEVELING AND APPARATUSES USEFUL IN FORMING IMAGES ON SUBSTRATES

RELATED APPLICATIONS

This application is related to U.S. patent application Ser. No. 12/881,753, filed Sep. 14, 2010, entitled "METHODS OF ADJUSTING GLOSS OF IMAGES LOCALLY ON SUBSTRATES USING INK PARTIAL-CURING AND CONTACT LEVELING AND APPARATUSES USEFUL IN FORMING IMAGES ON SUBSTRATES" and U.S. patent application Ser. No. 12/881,802, filed Sep. 14, 2012, "METHODS OF ADJUSTING GLOSS OF IMAGES ON SUBSTRATES USING INK PARTIAL-CURING AND CONTACT LEVELING AND APPARATUSES USEFUL IN FORMING IMAGES ON SUBSTRATES," which are filed on the same date as the present application, commonly assigned to the assignee of the present application, and the disclosure of which are hereby incorporated herein by reference in their entireties.

BACKGROUND

In printing processes, marking material is applied onto substrates to form images. In these processes, pressure can be applied to the substrates and marking material by contact with surfaces to level the marking material on the substrates. The marking material can offset to the surfaces, resulting in unsatisfactory fixed images.

It would be desirable to provide methods of forming images on substrates in printing and apparatuses for forming images that can form images on substrates with ink without offset of the ink to surfaces of the apparatuses.

SUMMARY

Methods of forming images on substrates in printing and apparatuses for forming images on substrates in printing are provided. An exemplary embodiment of the methods comprises applying ink onto a surface of a substrate; irradiating the ink on the surface of the substrate with first radiation to partially-cure the ink; applying pressure to the substrate and partially-cured ink at a nip with a first surface of a first member and a second surface of a second member to level the ink on the surface of the substrate; and irradiating the as-leveled ink on the surface of the substrate with second radiation to substantially fully cure the ink.

DRAWINGS

DETAILED DESCRIPTION

Figure 1:
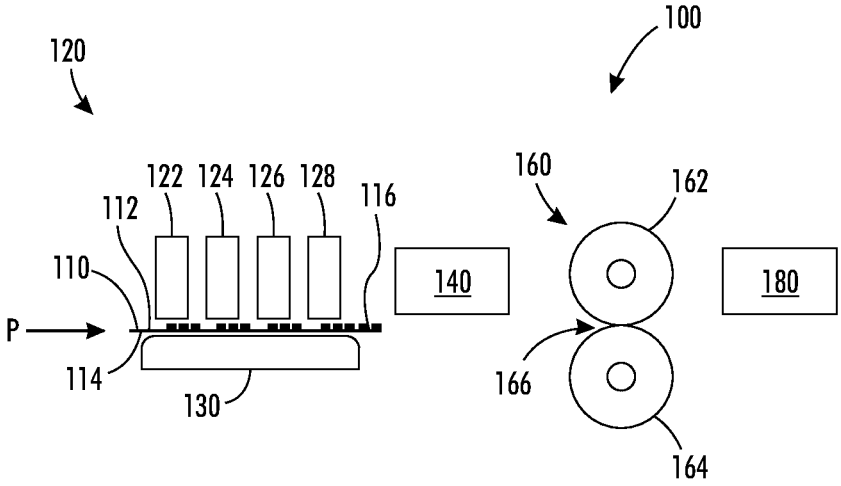
FIG. 1 depicts an exemplary embodiment of a printing apparatus for forming images on substrates with ink partial-curing and contact leveling of images.

The disclosed embodiments include methods of forming images on substrates in printing. An exemplary embodiment of the methods comprises applying ink onto a surface of a substrate; irradiating the ink on the surface of the substrate with first radiation to partially-cure the ink; applying pressure to the substrate and partially-cured ink at a nip with a first surface of a first member and a second surface of a second member to level the ink on the surface of the substrate; and irradiating the as-leveled ink on the surface of the substrate with second radiation to substantially fully cure the ink.

Another exemplary embodiment of the methods of forming images on substrates in printing comprises applying an ultra-violet (UV) curable ink onto a surface of a substrate; irradiating the UV-curable ink on the surface of the substrate with first UV radiation to partially-cure the UV-curable ink; applying pressure to the substrate and partially-cured UV-curable ink at a nip with a first surface of a first roll and a second surface of a second roll forming the nip to level the UV-curable ink on the surface of the substrate; and irradiating the as-leveled UV-curable ink on the surface of the substrate with second UV radiation to substantially fully cure the UV-curable ink.

The disclosed embodiments further include apparatuses for forming images on substrates in printing. An exemplary embodiment of the apparatuses comprises a marking device for applying ink onto a surface of a substrate; a partial-curing device for irradiating the ink on the surface of the substrate with first radiation to partially-cure the ink; a leveling device comprising a first member including a first surface, a second member including a second surface, and a nip formed by the first surface and the second surface, the first surface and the second surface apply pressure to the substrate and partially-cured ink received at the nip to level the ink on the surface of the substrate; and a second curing device for irradiating the as-leveled ink on the surface of the substrate with second radiation to substantially fully cure the ink.

Ultra-violet (UV) curable, phase change inks can be used with print heads to form images on substrates in printing. These inks have a viscous, gel-like consistency at ambient temperature. When these inks are heated from about ambient temperature to an elevated temperature, they undergo a phase change to a low-viscosity liquid. These inks can be heated until they change to a liquid and then ejected as ink droplets from a print head directly onto a substrate. Once the ejected ink impinges on the substrate, the inks cools and changes phase from the liquid phase back to its more-viscous, gel consistency.

A UV-curable gel ink applied to a substrate can be exposed to UV radiation to cure the ink. The term "curable" describes, for example, a material that may be cured via polymerization, including for example free radical routes, and/or in which polymerization is photoinitiated though use of a radiation-sensitive photoinitiator. The term "radiation-curable" refers, for example, to all forms of curing upon exposure to a radiation source, including light and heat sources and including in the presence or absence of initiators. Exemplary radiation-curing techniques include, but are not limited to, curing using ultraviolet (UV) light, for example having a wavelength of 200-400 nm or more rarely visible light, optionally in the presence of photoinitiators and/or sensitizers, curing using thermal curing, in the presence or absence of high-temperature thermal initiators (and which may be largely inactive at the jetting temperature), and appropriate combinations thereof.

However, for various applications it is desirable for the ink to be leveled prior to this UV curing. This leveling can produce more-uniform image gloss and mask missing jets of print heads. Additionally, certain print applications, such as packaging, may benefit from having thin ink layers of relatively-constant thickness on prints.

At ambient temperature these inks have very little cohesive strength prior to being cured. Moreover, these inks may be formulated to have good affinity to many types of materials. Consequently, it has been noted that conventional methods and devices used for flattening a layer of other ink types, such as a conventional fixing roll that may be used in xerography, are unsuitable for leveling gel inks prior to curing, because gel inks will tend to split and offset onto the device used to try to flatten it.

The gel inks may compromised primarily of curable monomers. These monomers are cross-linked during the photopolymerization process. It has been determined that increasing the room temperature viscosity of these inks to try to reduce ink offset onto surfaces is not a satisfactory approach. In order to increase the room temperature viscosity of such gel inks, substances that would need to be added to the ink would also elevate the viscosity at elevated temperature. Consequently, the ink would need to be heated to a higher temperature in print heads to maintain the ink at the required viscosity for jetting. However, because these inks may undergo thermal polymerization, an elevated print head temperature is undesirable.

In light of these observations regarding the formation of images on substrates with UV-curable inks, the present disclosure provides methods of forming images on substrates with ink that include partial-curing of the ink and contact leveling of the partially-cured ink, and apparatuses useful in forming images on substrates in printing. The methods and apparatuses can partially-cure ink applied to a substrate to allow the ink to then be leveled with applied pressure at a nip with zero, or substantially no, offset of the ink to contact surfaces of the leveling device.

FIG. 1 depicts an exemplary embodiment of a printing apparatus 100 useful in forming images on substrates with ink. The apparatus 100 includes a marking device 120, a partial-curing device 140, a leveling device 160 and a second curing device 180, arranged in this order along process direction, P. A substrate 110 having a front surface 112 and an opposite back surface 114 is shown. The marking device 120 is operable to deposit ink onto the front surface 112 of the substrate 110 to form an ink layer 116. The partial-curing device 140 is operable to irradiate the ink layer 116 with radiant energy effective to partially-cure the ink layer 116. The leveling device 160 levels (i.e., spreads) the partially-cured ink layer 116 on the front surface 112 of the substrate 110 by applying pressure to the ink layer 116. The second curing device 180 is operable to irradiate the as-leveled ink layer 116 with radiant energy to further cure the ink layer 116.

In embodiments, the marking device 120, partial-curing device 140 and second curing device 180 are stationary and the substrate 110 is moved past these devices while the ink layer 116 is being applied and then irradiated. The dosage of radiant energy applied to the substrate 110 can be controlled by controlling the dwell or intensity. The transport speed of the substrate 110 past the partial-curing device 140 and the second curing device 180 and the number of radiant energy sources of the partial-curing device 140 and second curing device 180 can be selected to control the exposure time of the ink layer 116. In embodiments, the radiant energy sources of the partial-curing device 140 and second curing device 180 can be turned ON throughout the partial-curing and second curing of the ink layer 116 to allow up to the entire front surface 112 to be irradiated as the substrate 110 is moved continuously past these devices.

The illustrated substrate 110 is a sheet. For example, the substrate 110 can be a sheet of plain paper, a polymer film, metal foil, packaging material, or the like. In other embodiments, the substrate can be in the form of a continuous web of material, such as plain paper, a polymer film, metal foil, packaging material, or the like.

In the illustrated embodiment, the marking device 120 includes a series of print heads 122, 124, 126 and 128, which are arranged in a "direct-to-substrate" arrangement to deposit ink droplets on the front surface 112 of the substrate 110 as the substrate 110 is advanced in the process direction P. For example, the print heads 122, 124, 126 and 128 can be heated piezoelectric print heads, MEMS (micro-electro-mechanical system) print heads, or the like. The print heads 122, 124, 126 and 128 can place different color separations onto the front surface 112 to build a desired full-color image according to input digital data.

The ink has a composition that allows it to be partially-cured and then further cured using radiant energy to fix robust images onto substrates. The ink can comprise ultraviolet light (UV)-curable ink containing one or more photoinitiator materials. UV-curable inks can be heated to an elevated temperature and jetted while at a low viscosity. When these inks impinge on a cooler substrate, such as paper at ambient temperature, the inks cool to the substrate temperature. During cooling, the inks may become increasingly viscous. When the UV-curable ink is exposed to UV radiation, polymerization and cross-linking occurs in the ink, which further increases its viscosity.

Exemplary inks that can be used to form images on substrates in embodiments of the disclosed methods and apparatuses are described in U.S. Pat. No. 7,665,835, which discloses a phase change ink comprising a colorant, an initiator, and an ink vehicle; in U.S. Patent Application Publication No. 2007/0123606, which discloses a phase change ink comprising a colorant, an initiator, and a phase change ink carrier; and in U.S. Pat. No. 7,559,639, which discloses a radiation curable ink comprising a curable monomer that is liquid at 25° C., curable wax and colorant that together form a radiation curable ink, each of which is incorporated herein by reference in its entirety.

The print heads 122, 124, 126 and 128 of the marking device 120 can be used to heat phase-change inks, for example, to a sufficiently-high temperature to reduce their viscosity for jetting as droplets from the nozzles of the print heads 122, 124, 126 and 128 onto the substrate 110. When a phase-change ink impinges on the substrate 110, heat is transferred from the ink to the cooler substrate 110. The as-deposited phase-change ink rapidly cools and develops a gel consistency on the substrate 110. Due to this rapid cooling, the phase-change ink does not have sufficient time to reflow laterally, or level, on the front surface 112 of the substrate 110 before developing the gel consistency.

In embodiments of the printing apparatus 100, the as-deposited ink layer 116 on the front surface 112 of the substrate 110 is irradiated by the partial-curing device 140 with radiant energy effective to partially-cure the ink. As used herein, the term "partial-cure" means that the radiant energy emitted by the partial-curing device 140 is effective to cause some photoinitiators contained in the ink to be activated such that only partial polymerization of the ink occurs. The ink may contain several photoinitiators where some are activated in part, and some are not activated at all by partial-curing radiation. As a result of this partial polymerization, the viscosity of the ink is increased to a sufficiently-high viscosity to allow the as-irradiated ink to be passed through a nip, where pressure is applied to the ink, without offset of the ink in the nip. When the substrate 110 enters the nip, the partially-cured ink layer has a viscosity that allows it to flow or spread on the front surface 112 of the substrate 110 when sufficient pressure is applied to provide the desired leveling of the ink layer on the front surface 112.

Figure 2:
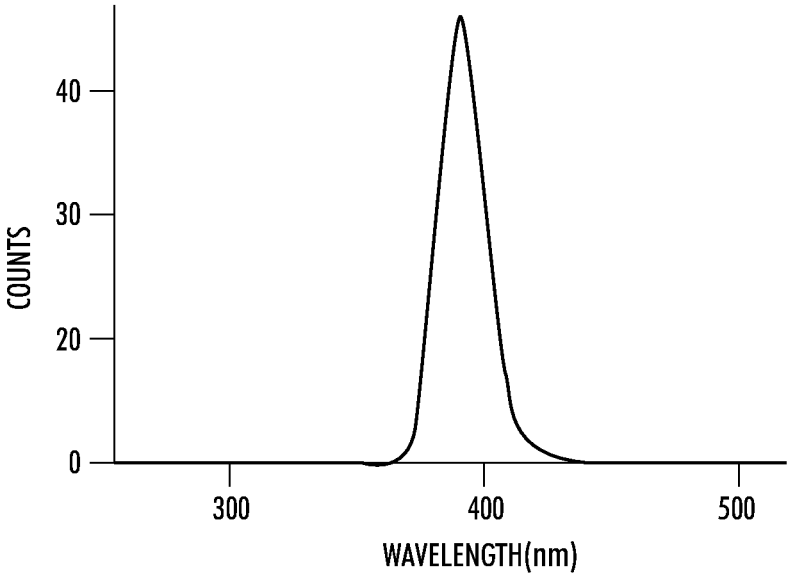
FIG. 2 depicts an exemplary spectrum of radiant energy that may be emitted by embodiments of the partial-curing device of the printing apparatus of FIG. 1.

The partially-cured ink layer 116 has viscosity and cohesion characteristics that allow it to be leveled using the leveling device 160 to spread the ink laterally on the front surface 112 to increase the line width of the ink layer 116. In embodiments, the partial-curing device 140 includes at least one radiant energy source. For example, the radiant energy source can be a light-emitting diode (LED) array, or the like. The radiant energy source can be selected to emit radiant energy having a spectrum that is optimized for the ink composition used in printing in order to produce optimized partial-curing of the ink layer 116. The spectrum of the radiant energy is generally provided by a graph giving the intensity of the radiant energy at a range of wavelengths extending from the far UV (about 100 nm wavelength) to the near UV (about 400 nm wavelength). FIG. 2 depicts an exemplary spectrum of the radiant energy emitted by the partial-curing device 140.

During partial-curing, the temperature of the substrate 110 and ink layer 116 can be controlled using a temperature-controlled platen 130. For example, the platen 130 can be at a temperature of about 10° C. to about 30° C., such as about 15° C. to about 20° C., to control the temperature of the substrate 110 and ink layer 116 to the desired temperature. The ink layer 116 may be at temperature below ambient temperature, at ambient temperature, or above ambient temperature during the partial-curing.

Figure 3:
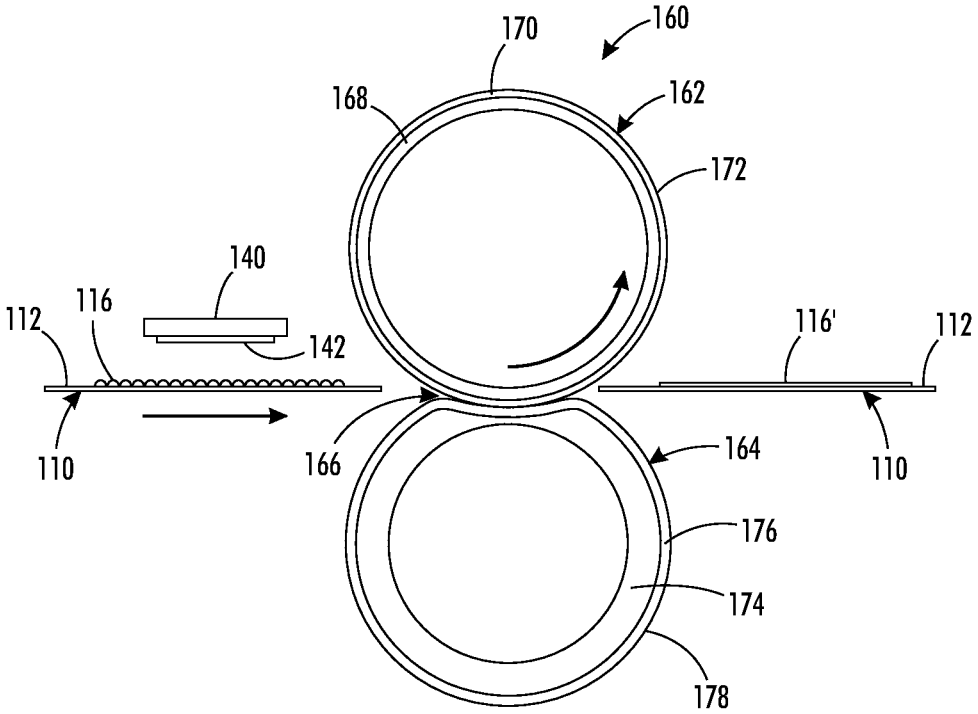
FIG. 3 shows a substrate including a front surface on which ink is disposed positioned at a partial-curing device prior to being received at a nip of a leveling device, and showing the substrate after passing through the nip.

The leveling device 160 includes members having opposed surfaces for applying pressure to the ink layer 116 on the substrate 110. The members can include two rolls; a first roll and a belt provided on a second roll; or two belts provided on rolls. FIG. 3 depicts an exemplary embodiment of the leveling device 160 including a leveling roll 162 and a pressure roll 164. An embodiment of the partial-curing device 140 including an LED array 142 is also shown. The leveling roll 162 and the pressure roll 164 contact each other at a nip 166 at which the substrate 110 and ink layer 116 are subjected to sufficient pressure to level the partially-cured ink layer 116 to produce the leveled ink layer 116'. Typically, the pressure applied at the nip 166 may range from about 10 psi to about 800 psi, such as about 30 psi to about 120 psi.

The leveling roll 162 can be made from various materials that provide the desired mechanical and chemical properties. For example, the illustrated leveling roll 162 includes a core 168 and an outer layer 170 including an outer surface 172 overlying the core 168. The core 168 can be comprised of a suitable metal, such as aluminum, an aluminum alloy, or the like. In embodiments, the outer layer 170 can be comprised of a durable, hydrophilic material. The outer layer 170 can be applied, e.g., as a coating over the core 168. In other embodiments, the outer layer 170 can be comprised of a polymer having suitable properties, such as a fluorinated polymer, or the like.

The pressure roll 164 can be made from various materials. The illustrated pressure roll 164 includes a core 174 and an outer layer 176 including an outer surface 178 overlying the core 174. In embodiments, the core 174 is comprised of a relatively-hard material. For example, the core 174 can be comprised of a suitable metal, such as steel, stainless steel, or the like. The outer layer 176 can be comprised of a material that is elastically deformed by contact with the leveling roll 162 to form the nip 166. For example, the outer layer 176 can be comprised of silicone rubber, or the like.

In embodiments, a release liquid can be applied to the hydrophilic outer surface 172 of the leveling roll 162 to wet the outer surface 172 to aid in the reduction of image offset during leveling. For example, the release liquid can be comprised substantially of water, with an effective amount of added detergent to reduce surface tension.

In the apparatus 100, the second curing device 180 includes at least one radiant energy source that is operable to emit radiant energy having a spectrum effective to substantially fully cure the ink layer 116 subsequent to the leveling of the ink layer 116 by the leveling device 160. In embodiments, the spectrum of the radiant energy source(s) of the second curing device 180 can be the same as, or can be different from, the spectrum of the radiant energy emitted by the radiant energy source(s) of the partial-curing device 140. For example, the second curing device 180 can comprise a UV-LED array that emits at a different peak wavelength and intensity than the radiant energy source(s) included in the partial-curing device 140.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A method of forming an image on a substrate in printing, comprising:

transporting a substrate along a transport path in a process direction;

cooling the substrate with a cooling device;

applying ink directly onto a surface of the cooled substrate from at least one of a plurality of fixed print heads;

irradiating the ink on the surface of the substrate with first radiation from a first radiation unit, the first radiation unit being physically positioned downstream of, and non-overlapping with, all of the plurality of fixed print heads in the process direction to partially-cure the ink on the surface of the substrate;

applying pressure to the substrate and the partially-cured ink already applied to the surface of the substrate at a nip of a leveling device with a first surface of a first member and a second surface of a second member to level the ink on the surface of the substrate, the first surface of the first member being formed of a hydrophilic material, and a release liquid comprising water and detergent being applied to the first surface of the first member; and irradiating the as-leveled ink on the surface of the substrate with second radiation from a second radiation unit downstream of the nip in the process direction to substantially fully cure the ink on the substrate.

2. The method of claim 1, the ink comprising a monomer, a photoinitiator, a colorant and at least one organic gellator.

3. The method of claim 1, wherein:

the ink comprises ultraviolet (UV)-curable ink; and the first radiation and the second radiation comprise UV radiation.

4. The method of claim 1, wherein:

the first member comprises a first roll including the first surface; and the second member comprises a second roll including the second surface.

5. The method of claim 1, wherein:

the first member comprises a first belt including the first surface; and the second member comprises a second belt including the second surface.

6. The method of claim 1, wherein the substrate is a sheet.

7. The method of claim 1, wherein the substrate is a web.

8. The method of claim 1, wherein the ink is applied directly onto the surface of the substrate with the plurality of fixed print heads to build a full-color image on the surface of the substrate prior to the irradiating of the ink on the surface of the substrate with the first radiation from the first radiation unit according to input digital data.

9. A method of forming an image on a substrate in printing, comprising:

transporting a substrate along a transport path in a process direction;

cooling the substrate with a cooling device;

applying an ultra-violet (UV) curable ink directly onto a cooled surface of the substrate from at least one of a plurality of fixed print heads;

irradiating the UV-curable ink on the surface of the substrate with first UV radiation from a first UV radiation unit, the first UV radiation unit being physically positioned downstream of, and non-overlapping with, all of the plurality of fixed print heads in the process direction to partially-cure the UV-curable ink on the surface of the substrate;

applying pressure to the substrate and the partially-cured UV-curable ink already applied to the surface of the substrate at a nip of a leveling device with a first surface of a first roll and a second surface of a second roll forming the nip to level the UV-curable ink on the surface of the substrate, the first surface of the first roll being formed of a hydrophilic material, and a release liquid comprising water and detergent being applied to the first surface of the first roll; and irradiating the as-leveled UV-curable ink on the surface of the substrate with second UV radiation from a second UV radiation unit positioned downstream of the nip in the process direction to substantially fully cure the UV-curable ink on the surface of the substrate.

10. The method of claim 9, the ink comprising a monomer, a photoinitiator, a colorant and at least one organic gellator.

11. The method of claim 9, wherein the UV-curable ink is applied directly onto the surface of the substrate with the plurality of fixed print heads to build a full-color image on the surface of the substrate prior to the irradiating of the ink on the surface of the substrate with the first UV radiation from the first UV radiation unit according to input digital data.

12. An apparatus for forming an image on a substrate in printing, comprising:

a transport device that transports a substrate along a transport path in a process direction;

a cooling device that cools the substrate;

a marking device for applying ink directly onto a cooled surface of the substrate from at least one of a plurality of fixed print heads;

a partial-curing device positioned physically downstream of, and non-overlapping with, all of the plurality of print heads in the process direction for irradiating the ink on the surface of the substrate with first radiation to partially-cure the ink on the surface of the substrate;

a leveling device positioned downstream of the partial-curing device in the process direction and comprising a first member including a first surface, a second member including a second surface, and a nip formed by the first surface and the second surface, the first surface and the second surface applying pressure to the substrate and the partially-cured ink previously applied to the substrate received at the nip to level the ink on the surface of the substrate, the first surface of the first member being formed of a hydrophilic material, and a release liquid comprising water and detergent being applied to the first surface of the first member; and a second curing device positioned downstream of the nip in the process direction for irradiating the as-leveled ink on the surface of the substrate with second radiation to substantially fully cure the ink on the surface of the substrate.

13. The apparatus of claim 12, wherein:

the ink comprises ultraviolet (UV)-curable ink; and the first radiation and the second radiation comprise UV radiation.

14. The apparatus of claim 12, wherein:

the first member comprises a first roll including the first surface; and the second member comprises a second roll including the second surface.

15. The apparatus of claim 12, wherein:

the first member comprises a belt including the first surface; and the second member comprises a belt including the second surface.

16. The apparatus of claim 12, wherein the plurality of fixed print heads of the marking device apply the ink onto the surface of the substrate to build a full-color image on the surface of the substrate prior to the irradiating of the ink on the surface of the substrate with the first radiation from the first radiation unit according to input digital data.

* * * * *